US009308420B2

(12) United States Patent
Davis

(10) Patent No.: US 9,308,420 B2
(45) Date of Patent: Apr. 12, 2016

(54) BALL RETRIEVING APPARATUS

(71) Applicant: Brett Davis, Columbia, PA (US)

(72) Inventor: Brett Davis, Columbia, PA (US)

( * ) Notice: Subject to any disclaimer, the term of this patent is extended or adjusted under 35 U.S.C. 154(b) by 0 days.

(21) Appl. No.: 14/659,746

(22) Filed: Mar. 17, 2015

(65) Prior Publication Data

US 2015/0273283 A1 Oct. 1, 2015

Related U.S. Application Data

(60) Provisional application No. 61/971,742, filed on Mar. 28, 2014.

(51) Int. Cl.
*A63B 47/02* (2006.01)

(52) U.S. Cl.
CPC ..... *A63B 47/02* (2013.01)

(58) Field of Classification Search
CPC ..... A63B 47/02; A63B 47/025
USPC ..... 294/19.2; 473/286, 460
See application file for complete search history.

(56) References Cited

U.S. PATENT DOCUMENTS

| | | | | | |
|---|---|---|---|---|---|
| 2,207,546 | A | | 1/1936 | McDonald | |
| 2,760,807 | A | | 8/1956 | Watson | |
| 3,186,593 | A | * | 6/1965 | Miotke | A63B 47/02 221/199 |
| 3,412,897 | A | | 11/1968 | Slater | |
| 4,058,336 | A | | 11/1977 | Parkinson | |
| 4,629,235 | A | | 12/1986 | Logue | |
| 5,188,410 | A | | 2/1993 | Summers | |
| 5,340,179 | A | * | 8/1994 | Rubin | A63B 47/02 294/19.2 |
| 5,505,510 | A | | 4/1996 | Duncan | |
| 5,775,751 | A | | 7/1998 | Nelson | |
| 6,386,607 | B1 | * | 5/2002 | Deininger | A63B 47/02 221/194 |
| 7,165,796 | B1 | | 1/2007 | Hung | |
| D580,999 | S | | 11/2008 | Mitchell | |
| D606,603 | S | | 12/2009 | Compton | |
| 2007/0191131 | A1 | * | 8/2007 | Nickel | A63B 47/02 473/285 |
| 2008/0185855 | A1 | * | 8/2008 | Compton | A63B 47/02 294/19.2 |
| 2011/0062731 | A1 | * | 3/2011 | Milikovsky | A63B 47/02 294/19.2 |

* cited by examiner

*Primary Examiner* — Stephen Vu
(74) *Attorney, Agent, or Firm* — Miller Law Group, PLLC

(57) ABSTRACT

A ball retrieving apparatus is formed with a tubular storage chamber on which is mounted a gateway mechanism at the lower end thereof. The gateway mechanism is formed of a cylindrical housing having a passageway therethrough for alignment with the tubular storage chamber engaged therewith. The housing incorporates a ring of spring-loaded detent balls that are biased to project into the passageway to restrict the effective diameter thereof. Balls being retrieved are pressed into the housing to retract the detent balls against the biasing force until the ball has passed the ring of detent balls. The biasing force on the detent balls will retain the collected balls within the tubular storage chamber until the chamber is emptied. The ball retrieving apparatus can be sized to receive any type of sports activity ball.

14 Claims, 4 Drawing Sheets

BALL RETRIEVING APPARATUS

CROSS-REFERENCE TO RELATED APPLICATIONS

This application claims domestic priority from U.S. Provisional Patent Application Ser. No. 61/971,742, filed on Mar. 28, 2014, the content of which is incorporated herein by reference.

FIELD OF THE INVENTION

This invention relates generally to devices for retrieving balls from the practice field, and more particularly, to a tubular apparatus having a plurality of spring-loaded detents circumferentially arranged around the entrance to a tubular storage device to retain a column of balls within the tubular storage device.

BACKGROUND OF THE INVENTION

Many sports utilize a small diameter round ball in the performance of the sporting event. Practice for the sporting event typically utilized a large number of the small diameter round balls to keep the practice session moving smoothly. When the practice session is completed, these balls are typically scattered over the practice area and require retrieval. For example, baseball and softball teams typically utilize dozens of balls during practice, particularly during batting practice. Even when batting practice is conducted with the batter hitting balls into a net, a substantial number of balls are used. Similarly, tennis, field hockey, golf and lacrosse, whether practice is for individual players or teams, utilize a substantial number of small diameter balls. Golf is another sport activity that utilizes a significant number of balls during practice.

A number of retrieving devices have been devised to facilitate the retrieval of loose, small diameter balls. Substantially all of these devices utilize a tubular storage chamber to store a supply of the balls that have been retrieved and a gateway mechanism at one end of the tubular storage chamber that is engaged by the ball being retrieved and allows the ball to pass the mechanism to enter the tubular storage chamber, yet be retained by the mechanism within the tubular storage chamber once the ball has passed by the mechanism. Also common in the prior art ball retrieving devices is that the gateway mechanism must pass beneath the maximum diameter of the ball being loaded into the storage chamber before the ball is completely pressed into the ball retrieving device.

In U.S. Pat. No. 2,760,807, granted on Aug. 28, 1956, to William Watson, the mechanism at the end of the tubular storage chamber is formed as deformable lips that deflect inwardly to allow the ball to pass into the tubular storage chamber and then deflect back into the normal position once the ball has passed into the chamber. The deformable lips are not arranged to deflect downwardly, only inwardly and upwardly; therefore, the balls retained in the storage chamber cannot pass the deformable lips to exit the chamber. Similarly operable yieldable strips are utilized as the gateway mechanism in the device for picking up baseballs disclosed in U.S. Pat. No. D580,999, granted on Nov. 18, 2008, to Joseph Mitchell, and also in the device for picking up golf balls in U.S. Pat. No. 7,165,796, granted on Jan. 23, 2007, to Shao-Fu Hung.

The gateway mechanism disclosed in U.S. Pat. No. 4,058,336, issued to Sydney Parkinson on Nov. 18, 1977, is a pivoted cam finger connected to an actuation pawl. When the loading end of the tubular storage chamber is placed over a ball to be retrieved, the cam finger pivots upwardly to allow the curved, small diameter ball to pass into the storage chamber. Once the maximum diameter of the ball is passed by the cam finger, a resilient strap passing around the tubular apparatus and engaged with the cam finger pivots the cam finger back into the interior of the tubular apparatus to prevent the retrieved ball now within the storage chamber from exiting the storage chamber. The actuation pawl is integrally formed with the cam finger and can be manually operated to force the cam finger to pivot back out of the interior of the tubular member against the biasing force exerted by the resilient strap to permit one or more balls, as desired, to be removed from the storage chamber as long as the cam finger is manually retracted.

The ball retrieval storage and discharge device disclosed in U.S. Pat. No. 5,775,751, issued to Ryan Nelson on Jul. 7, 1998, utilizes a plurality of circumferentially spaced spheres retained in openings formed in the interior of the tubular storage member. An outer collar is mounted on the exterior surface of the tubular storage member in alignment with the circumferentially spaced array of spheres retained in the tubular storage member. The outer collar is formed on the interior surface against the exterior surface of the tubular member with a plurality of flat sides meeting at interior angles. The collar is rotatable on the exterior surface of the tubular storage member such that the spheres can be aligned with either the sides or the interior angles between the flat sides. When aligned with the flat sides, the spheres are forced against the openings formed in the interior surface of the tubular storage member to project into the interior of the tubular storage member and, thus, reducing the effective diameter of the tubular storage member and, thereby, retaining balls within the tubular storage member. Once the collar is rotated so that the spheres are aligned with the interior angles, the spheres have enough room to retract from the interior of the tubular storage member by the weight of the ball or balls stored therein and, thereby, allow the discharge of stored balls out of the device.

The devices disclosed in U.S. Pat. No. 4,629,235 granted to Dewitt Logue on Dec. 16, 1986, and in U.S. Pat. No. 5,188,410 granted to Michael Summers on Feb. 23, 1993, rely on the ball to be deformable for proper operation. In these patents, the inlet throat of the tubular storage chamber is restricted in diameter in a fixed manner. Forcing the restricted diameter onto a deformable ball, such as a tennis ball, causes the ball to deform and pass into the tubular storage chamber above the restricted diameter and be retained therein by the restricted diameter since there is insufficient force from the mere weight of the ball or balls within the tubular storage chamber to cause deformation of the lowermost ball. In U.S. Pat. No. 5,188,410, the restricted diameter is formed by a reduced diameter ring, while in U.S. Pat. No. 4,629,235, the diameter restriction is provided by a plurality of projections affixed to the interior of the tubular storage chamber.

Another form of a gateway mechanism is disclosed in U.S. Pat. No. 3,412,897, issued on Nov. 26, 1968, to Charles Slater, and in U.S. Pat. No. 5,505,510, issued on Apr. 9, 1996, to James Duncan, as a circumferentially arranged plurality of yieldable fingers forming a restricted opening at the loading end of the tubular storage chamber. The fingers deflect radially outwardly when the curved ends of the fingers are pressed onto a round, small diameter ball to expand the diameter of the opening to allow the passage of the ball into the tubular storage chamber. Once the maximum diameter of the ball has passed the curved ends of the yieldable fingers, the fingers retract to the original restricted opening position, thus retaining the ball or balls within the tubular storage chamber above the fingers. Discharge of the collected balls is accomplished through the opposing end of the tubular storage chamber, which can either be open or closed by a removable cap.

The plurality of yieldable fingers to form the gateway mechanism for a ball retriever device is also deployed in U.S. Pat. No. D606,603, granted on Dec. 22, 2009, to Michael Compton, and in U.S. Pat. No. 2,207,546, granted on Jan. 14, 1936, to Ian Macdonald. In U.S. Pat. No. 2,027,546, the yieldable fingers are similar in function to the yieldable fingers disclosed in U.S. Pat. No. 3,412,897 and in U.S. Pat. No. 5,505,510, except that the fingers in U.S. Pat. No. 2,027,546 are affixed to the outside of the tubular storage chamber and project into the interior of the chamber through openings at the bottom of the chamber. The curved ends of the yieldable fingers are forced outwardly pushing the fingers away from the tubular storage chamber when forced onto a round, small diameter ball. The fingers deflect back into chamber as the ball passes the curved ends of the fingers.

In U.S. Pat. No. D606,603, the fingers are formed as part of a ring mounted on the outside of the tubular storage chamber and are wrapped around the distal end of the tubular storage such that only the curved ends are located interiorly of the chamber. When forced onto a round, small diameter ball, the curved ends deflect against the interior surface of the tubular storage chamber to allow the passage of a baseball. Once the maximum diameter of the baseball has passed the ends of the fingers, the curved ends deflect inwardly to trap the collected ball within the tubular storage chamber.

The primary disadvantage of each of these prior art ball retrieval devices is the force required to deflect the gateway mechanism to allow the passage of a small diameter ball into the interior of the tubular storage chamber. The amount of force needed to deflect the curved finger ends of the apparatus shown in U.S. Pat. No. D606,603, which is commercially available, is a significant disadvantage. In addition, the design of the curved fingers in D606,603 has an inherent stress fracturing area at the curved radius where the fingers project into the opening of the tubular storage area. With the flexing of the curved fingers necessary for the passage of a baseball into the tubular storage area, the curved fingers, even though formed of spring steel, will yield and break at this curved radius.

Accordingly, it would be desirable to provide a ball retrieving apparatus that would improve the ease of retrieving balls from the practice area. It would also be desirable to provide a spring-loaded retention mechanism for retaining a column of retrieved balls within the tubular storage area while providing a gateway mechanism that is easily operable.

SUMMARY OF THE INVENTION

It is an object of this invention to provide an apparatus for retrieving balls from a practice are that overcomes the disadvantages of the prior art devices.

It is another object of this invention to provide a ball retrieving apparatus that includes a spring-loaded retention mechanism for retaining a column of balls within a tubular storage member.

It is a feature of this invention that the ball retrieving apparatus is formed as a tubular column having an inside diameter slightly larger than the diameter of the types of balls to be retrieved.

It is an advantage of this invention that the ball retrieving apparatus can be sized to correspond to the particular type of ball being retrieved.

It is another feature of this invention that the lower end of the tubular column is formed with a spring detent mechanism to retain the collected balls within the tubular column above the spring detent mechanism.

It is still another object of this invention to provide a ball retrieving apparatus that includes a tubular storage chamber having a gateway mechanism affixed at the lower end of the tubular storage chamber.

It is another feature of this invention that the gateway mechanism includes a cylindrical housing sized for engagement with the tubular storage chamber to be coupled thereto.

It is another advantage of this invention that the gateway mechanism can be separated from the tubular storage chamber to permit separate manufacture and replacement of both the gateway mechanism and the tubular storage chamber.

It is still another feature of this invention that the gateway mechanism includes a housing mounting a plurality of spring-loaded detent balls arranged circumferentially around the housing.

It is still another advantage of this invention that the housing can be formed in a manner to extend from the end of the tubular storage chamber or to be mounted on the exterior of the lower end of the tubular storage chamber.

It is yet another feature of this invention that the detent balls are biased to project into the interior of the housing to reduce the effective diameter of the housing so that the balls collected in the tubular storage chamber will be retained therein.

It is still another feature of this invention that the detent balls will retract into the housing against the spring biasing the detent balls inwardly by the force of a ball being retrieved as that ball is pressed against a rigid surface, such as the ground.

It is yet another advantage of this invention that the biasing force exerted by the springs on the detent balls is sufficient to prevent the weight of a fully loaded tubular storage chamber without causing the detent balls to retract.

It is yet another object of this invention to provide a baseball retrieving apparatus that can be carried over the practice field to pick up loose balls in a convenient manner.

It is a further feature of this invention that the array of detent balls is positioned on the housing at a location that retains the ball internally of the housing and tubular storage chamber.

It is a further object of this invention to provide a ball retrieving apparatus which is durable in construction, inexpensive of manufacture, carefree of maintenance, facile in assemblage, and simple and effective in use.

These and other objects, features and advantages are accomplished according to the instant invention by providing a ball retrieving apparatus having a tubular storage chamber on which is mounted a gateway mechanism at the lower end thereof. The gateway mechanism is formed of a cylindrical housing having a passageway therethrough for alignment with the tubular storage chamber engaged therewith. The housing incorporates a ring of spring-loaded detent balls that are biased to project into the passageway to restrict the effective diameter thereof. Balls being retrieved are pressed into the housing to retract the detent balls against the biasing force until the ball has passed the ring of detent balls. The biasing force on the detent balls will retain the collected balls within the tubular storage chamber until the chamber is emptied. The ball retrieving apparatus can be sized to receive any type of sports activity ball.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENT

Figure 1:
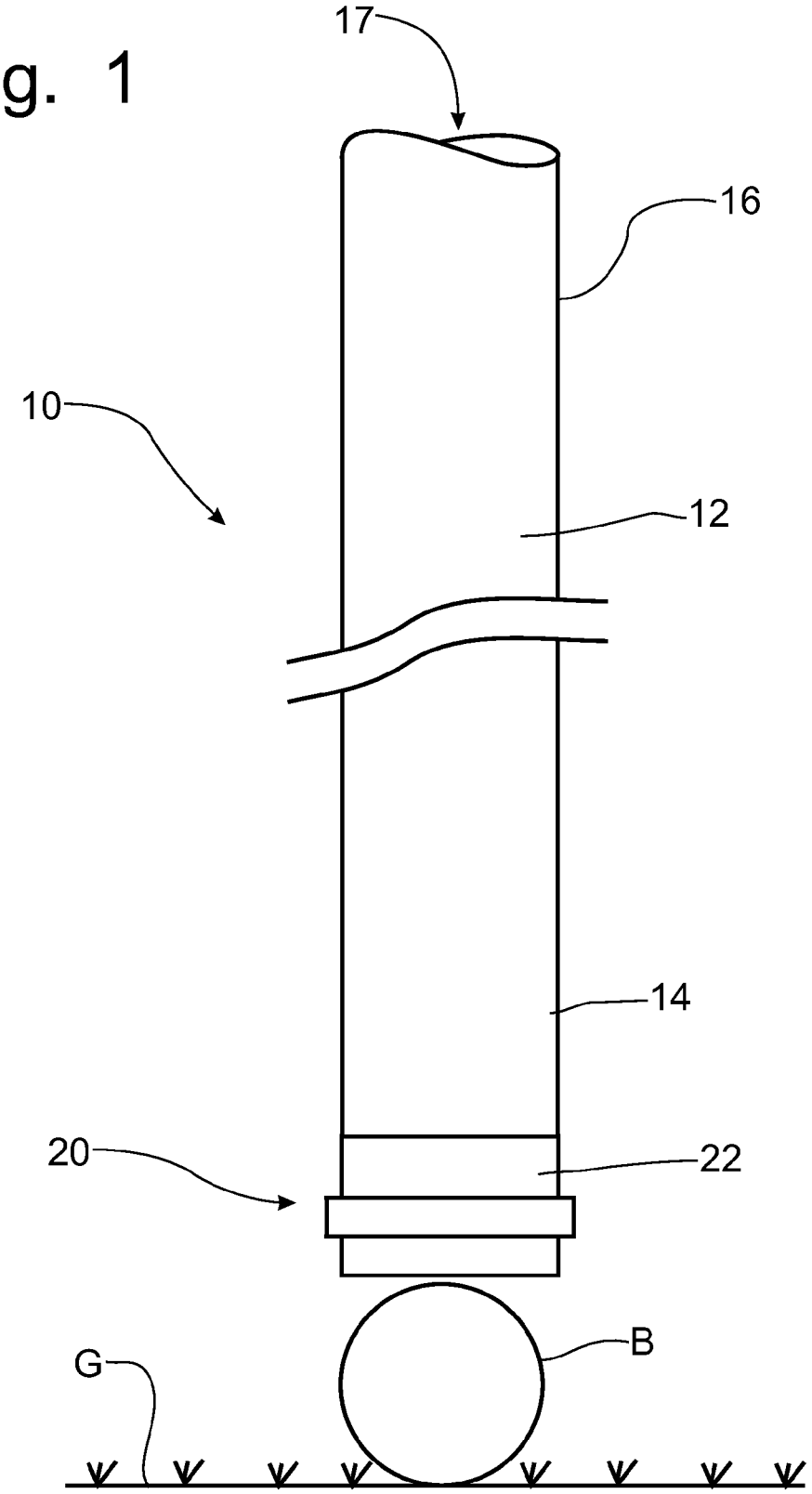
FIG. 1 is an elevational view of the ball retrieving apparatus positioned above a ball lying on the surface of the ground.
Figure 3:
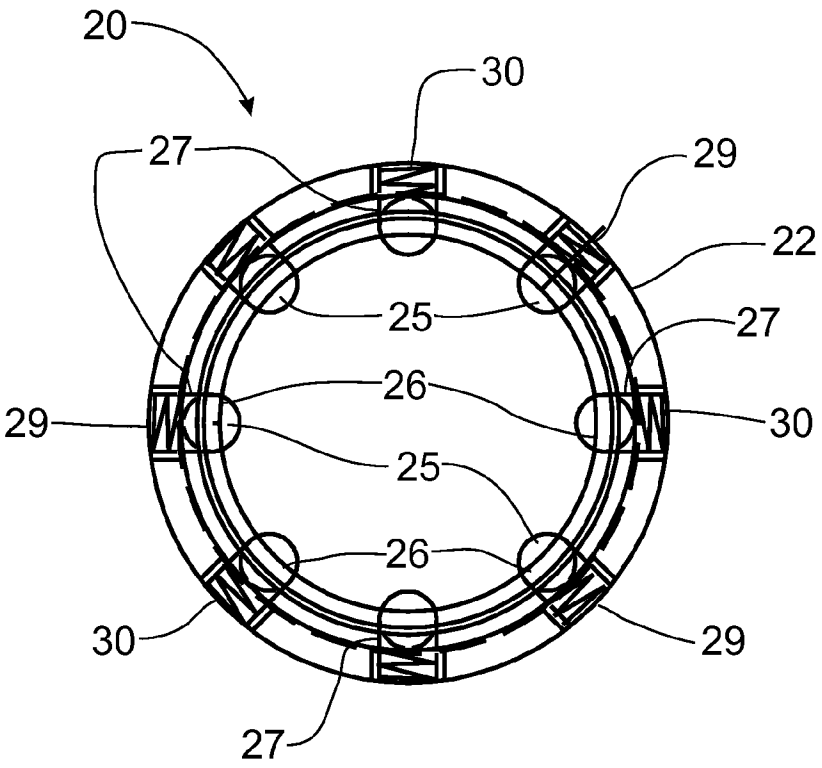
FIG. 3 is a top plan view of the gateway mechanism with the detent balls in the operative position projecting into the interior of the housing to prevent a collected ball from leaving the storage chamber.
Figure 2:
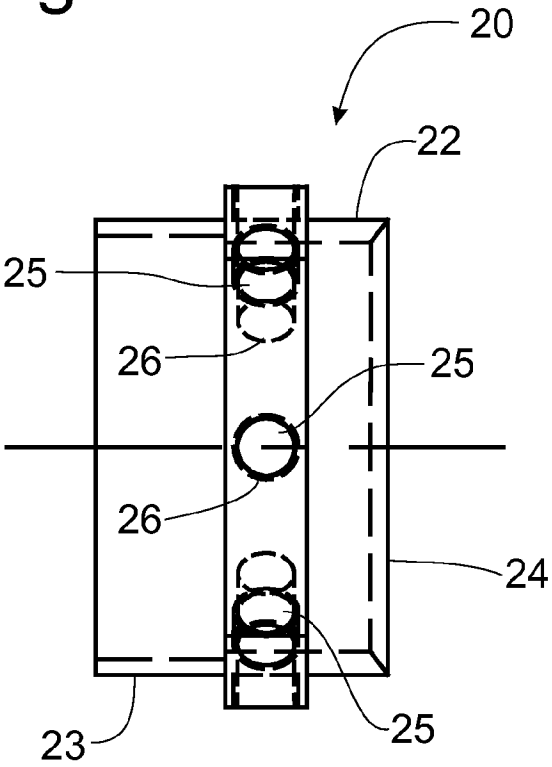
FIG. 2 is a side elevational view of the gateway mechanism mounted on the lower end of the tubular storage chamber to allow the passage of a ball while being operable to retain any collected balls within the chamber.
Figure 5:
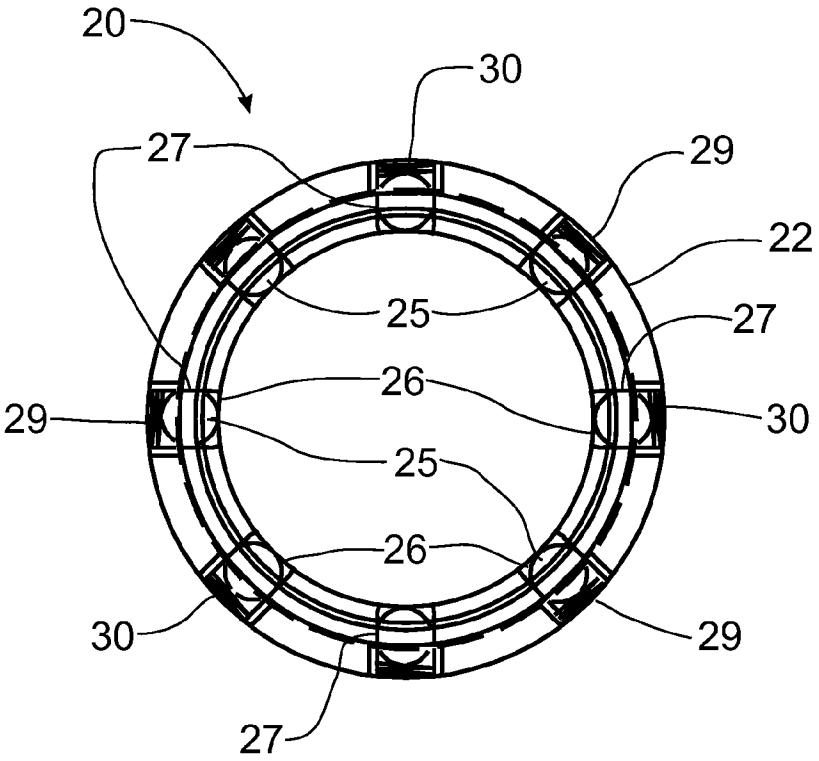
FIG. 5 is a top plan view of the gateway mechanism with the detent balls retracted to allow the passage of a ball forcing the retraction detent balls.
Figure 4:
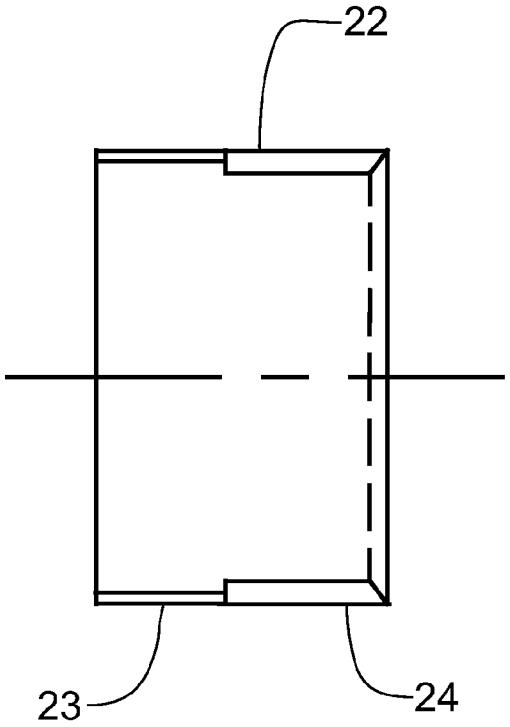
FIG. 4 is a cross-sectional view of the housing with the gateway mechanism broken away for purposes of clarity to show the offset nature of the housing for connection to the tubular storage chamber.

Referring now to the drawings, a ball retrieving apparatus incorporating the principles of the instant invention can best be seen. Any references to upper or lower are used as a matter of convenience and are determined by the location of the gateway mechanism, as defined in greater detail below, with the gateway mechanism being located at the lower end of the apparatus and the upper end having a discharge opening through which the balls collected into the storage chamber can be emptied. The primary embodiment of the instant invention shown in the drawings and described herein is used to collect small diameter balls, particularly baseballs. However, the apparatus 10 can be used to collect any ball, such as softballs, field hockey balls and lacrosse balls, although modifications in the diameter of the tubular storage chamber 12 and the gateway mechanism 20, as well as the location of the gateway mechanism 20 relative to the lower end 14 of the storage chamber 12, as will be described in greater detail below, would have to be made to accommodate the differently sized balls.

As best seen in FIG. 1, the apparatus 10 includes a tubular storage chamber 12 that has a lower end 14 and an upper end 16. The overall length of the tubular storage chamber 12 measured between the lower and upper ends 14, 16, can be varied to be customized to the potential user of the apparatus 10, but preferably, the tubular storage chamber 12 would have an overall length of approximately six feet, which would be a sufficient length to hold 24 baseballs. The inside diameter of the tubular storage chamber 12 to accommodate baseballs would be approximately three inches, which would be just slightly larger than the standard diameter of a baseball. The lower end 14 is provided with a gateway mechanism 20, while the upper end 16 is preferably an open discharge opening 17 through which the collected baseballs can be discharged simply by upending the tubular storage chamber 12. Optionally, a cap and a handle (not shown) can be fitted onto the upper end 16.

The gateway mechanism 20 is best seen in FIGS. 2-7. The gateway mechanism 20 is affixed to the lower end 14 of the tubular storage chamber 12 such as through an interference fit, as will be described in greater detail below, or the gateway mechanism 20 can be detachably connected to the tubular storage chamber 12 to permit replacement or servicing of the gateway mechanism 20. The gateway mechanism 20 includes a housing 22 that has an upper portion 23 and a lower portion 24. The upper portion 23 has an inside diameter that is identical to the outside diameter of the tubular storage chamber 12, while the lower portion 24 has an inside diameter that is substantially equal to the inside diameter of the tubular storage chamber 12. The lower end 14 of the tubular storage chamber 12 can be pressed into the upper portion 23 of the housing 22 to secure the housing 22 onto the chamber 12. With the lower portion 24 having an inside diameter equal to that of the tubular storage chamber 12, a small diameter ball can smoothly pass through the lower portion 24 of the housing 22 and into the chamber 12.

The housing 22 secures a plurality of spring-loaded detent balls 25 that project through an opening 26 formed into the interior surface of the housing 22 such that the effective diameter measured between the detent balls 25 is less than two and nine tenths inches, the standard diameter of a baseball. Each detent ball 25 has a diameter that is slightly larger than the opening 26 in the interior surface of the housing 22 so that the housing 22 allows the detent balls 25 to project through the interior surface of the housing 22, but not pass through the opening 26.

Each detent ball 25 is aligned with an internal passageway 27 formed within the housing 22 so that the detent ball 25 can retract into the housing 22 into a retracted position that allows a baseball to pass into the tubular storage chamber 12. Behind each detent ball 25 within the passageway 27 lies a biasing spring 30 that pushes the corresponding detent ball 25 inwardly toward the opening 26 so that the normal operative position of each detent ball 25 is at a maximum projection through the interior surface of the housing 12, which interferes with the passage of a baseball, or other appropriately sized small diameter ball. The passageway 27 continues through the housing 22 to exit the exterior surface of the housing 22 to facilitate the loading of the detent ball 25 and the biasing spring 30 during assembly of the gateway mechanism 20. The outer end of the passageway 27 is preferably threaded to enable a screw 29 to be engaged into the passageway 27 to provide a seat for the assertion of a biasing force by the spring 30 onto the detent ball 25.

Figure 7:
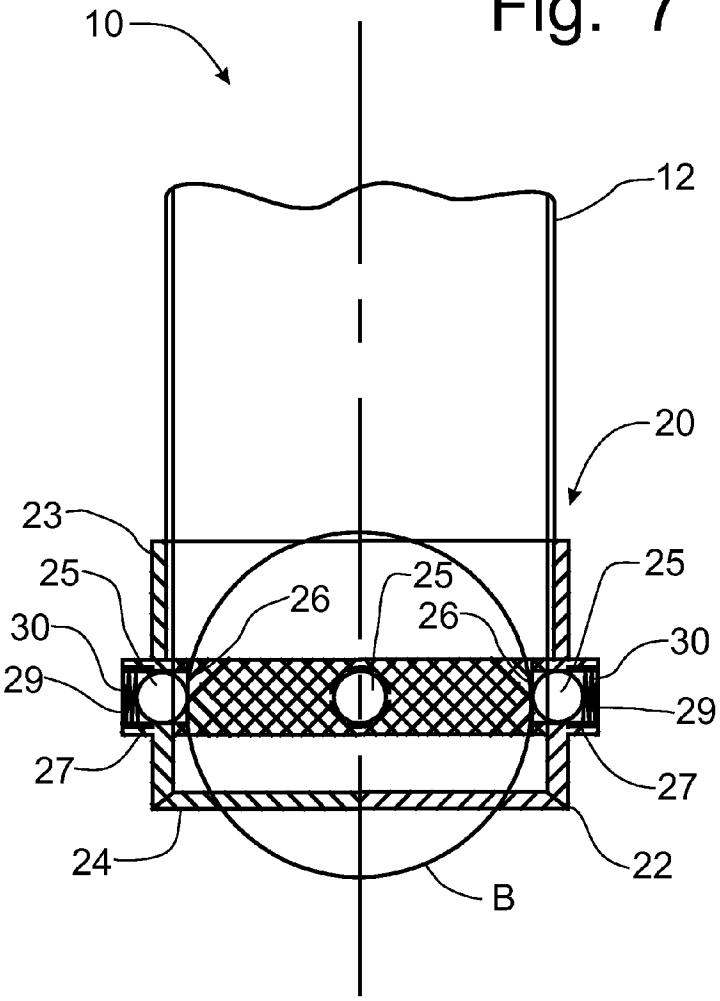
FIG. 7 is a partial cross-sectional view similar to that of FIG. 6, but showing the retraction of the detent balls forced by the entrance of a ball being picked up from the ground.
Figure 6:
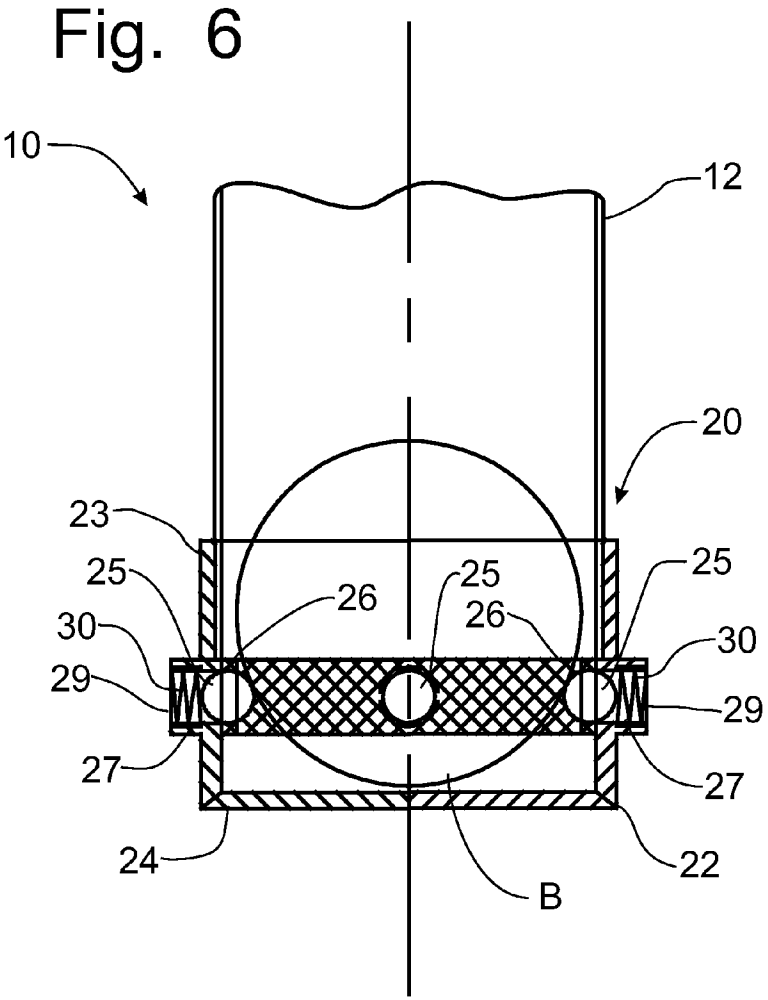
FIG. 6 is a partial cross-sectional view through the ball retrieving apparatus showing a ball that is retained within the storage chamber by the detent balls projecting through the interior surface of the housing of the gateway mechanism, alternatively, the ball is also displayed as passing the location of the detent balls upon being loaded into the tubular storage chamber.

The force exerted by the biasing spring 30 is sufficient to withstand the total weight of collected baseballs within the tubular storage chamber 12. Therefore, even when the chamber 12 is filled with baseballs, the lowermost baseball cannot pass through the gateway mechanism 20 because the detent balls 25 interfere with the passage of the lowermost baseball through the housing 22. Each of the biasing springs 30, however, can be retracted, as is depicted in FIG. 7, with the exertion of sufficient force onto the corresponding detent ball 25, which can be asserted by the pressing of the gateway mechanism 20 onto a baseball to be retrieved. The position of the detent balls 25 relative to the distal end of the housing 22 is less than one and a quarter inches so that the movement of the baseball into the tubular storage chamber 12, as described in greater detail below, will allow the detent balls 25 to move toward the operative position after the maximum diameter of the baseball has passed the location of the detent balls 25, as is depicted in FIG. 6.

Since the maximum weight of a standard baseball is five and a quarter ounces, the collection of 24 baseballs into a tubular storage chamber 12 could assert a total weight of less than eight pounds onto all of the detent balls 25. Assuming that the housing would contain eight detent balls 25, the biasing springs 30 should have no more than about a pound of force urging each detent ball 25 into the housing 22. Providing a safety factor in the event that the weight of the collected baseballs are carried by less than all of the detent balls 25, each biasing spring should still not have to provide a biasing force of more than about two pounds. Therefore, the amount of force needed to retract the detent balls 25 to allow the passage of a baseball into the tubular storage chamber 12 should not be more than about sixteen pounds, which is substantially less than is presently associated with known prior art baseball retrieving devices.

In operation, as is depicted in FIG. 1, the apparatus 10 is carried by a user to the location of a baseball B lying on the surface of the ground G. The lower end 14 is positioned over the baseball B so that the baseball B is aligned with the housing 22 and the baseball B is engaged with the detent balls 25 in their inwardly projecting operating position. The user then presses downwardly on the apparatus 10 with sufficient force to retract the detent balls 25 into the passageways 27, as shown in FIG. 7, by compressing the biasing springs 30. The baseball B being collected can then pass through the housing 22 until the maximum diameter of the baseball passes the location of the detent balls 25, as depicted in FIG. 6, whereupon the detent balls 25 will be urged back into their normal operating positions by the biasing springs 30. The collected baseball will then be retained within the tubular storage chamber by the detent balls 25, as is also reflected in FIG. 6.

When a subsequent baseball B is to be collected, the same alignment process is accomplished and the apparatus 10 pressed down onto the baseball B. The same action of retracting the detent balls 25 occurs and the subsequent baseball is passed through the housing 12 pushing the previous baseball or baseballs within the tubular storage chamber 12 upwardly toward the upper end 16. The process is repeated until the tubular storage chamber 12 is filled with collected baseballs, whereupon the apparatus 10 can be carried to a desired remote location for discharge of the collected baseballs by upending the apparatus 10 to discharge the collected baseballs through the upper end 16. If an optional cap (not shown) is utilized, the apparatus 10 can be carried in horizontal orientation to the remote location without loss of the collected baseballs through either the lower or upper ends 14, 16.

As noted above, the apparatus 10 can be sized to be utilized with any ball, but particularly with any small diameter ball. For example, an apparatus 10 sized to retrieve softballs should have an inside diameter for the tubular storage chamber of approximately four inches, or just slightly larger than a standard softball. However, some standard softballs have a slightly larger diameter and would require an appropriately larger diameter on the tubular storage chamber 12. Similarly, the location of the detent balls 25 would need to be raised slightly to accommodate the larger sized softball, as compared to the dimensions noted above with respect to baseballs. Furthermore, the apparatus 10 can be sized to retrieve any small diameter ball in the same manner as described above. Likewise, the size of the biasing springs 30 may need to be changed slightly to withstand the weight of a filled tubular storage chamber 12.

The apparatus 10 could also be sized to be able to retrieve larger diameter balls including soccer balls, basketballs, and volleyballs. The weight of the apparatus 10 could be a limiting factor, although the tubular storage chamber can be constructed from substantially any rigid material, including fiberglass, plastic, carbon fiber, and other lightweight, strong materials.

An alternative configuration of the housing 22 would have the detent balls 25 projecting into the interior of the tubular storage chamber 12 through holes (not shown) drilled into the lower end 14 of the tubular storage chamber 12 with the housing 22 being mounted completely on the exterior surface of the tubular storage chamber 12. The housing 22 would still be formed with the passageways 27 to housing the biasing springs 30 that push the detent balls 25 into engagement with the openings (not shown) formed into the lower end 14 of the tubular storage chamber 12.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A ball retrieving apparatus, comprising:

an elongated tubular storage chamber; and a gateway mechanism mounted on a lower end of said tubular storage chamber to allow the passage of balls into said tubular storage chamber while preventing balls retained within said tubular storage chamber from passing back through said gateway mechanism, said gateway mechanism including a passageway therethrough for the passage of balls into said tubular storage chamber, said gateway mechanism including:

a cylindrical housing; and an array of detent balls mounted on said housing to project into said passageway and to reduce the effective diameter of said passageway, whereby the balls retained within said tubular storage chamber are restricted from passing through said passageway, each respective said detent ball in the array of detent balls being spring-loaded to be biased toward a restricting position projecting into said passageway, said detent balls being movable into a non-restricting position when forced from said restricting position by engagement with one of said balls, but returning to said restricting position after passage of said one of said balls without requiring operator manipulation of said gateway mechanism.

2. The ball retrieving apparatus of claim 1 wherein said housing is formed with a support ring projecting radially from said housing to house respective biasing springs and corresponding detent balls of said array of detent balls.

3. The ball retrieving apparatus of claim 1 wherein the combined forces of the biasing springs exerted on the detent balls is greater than the weight of a maximum number of balls that can be retained in said tubular storage chamber.

4. The ball retrieving apparatus of claim 1 wherein said housing is formed to receive an end of said tubular storage chamber within a portion of said housing allowing said passageway to be in communication with said tubular storage chamber.

5. The ball retrieving apparatus of claim 4 wherein said housing is formed with an upper portion and a lower portion, said upper portion having an inside diameter that is substantially equal to an outside diameter of said tubular storage chamber, said lower portion having an inside diameter that is substantially equal to an inside diameter of said tubular storage chamber.

6. A baseball retrieving apparatus, comprising:

an elongated tubular storage member including an inside diameter that is sized to receive a baseball therein; and a gateway mechanism mounted on a lower end of said tubular storage member to allow the passage of baseballs into said tubular storage member while preventing baseballs retained within said tubular storage member from passing back through said gateway mechanism, said gateway mechanism including a passageway therethrough for the passage of baseballs into said tubular storage member, said gateway mechanism including:

a cylindrical housing; and a circumferential array of detent balls mounted on said housing to project into said passageway and to reduce the effective diameter of said passageway, whereby the baseballs retained within said tubular storage chamber are restricted from passing through said passageway, each respective said detent ball in the array of detent balls being spring-loaded to be biased toward a restricting position projecting into said passageway, said detent balls being movable into a non-restricting position when forced from said restricting position by engagement with one of said baseballs, but returning to said restricting position after passage of said one of said baseballs without requiring operator manipulation of said gateway mechanism.

7. The baseball retrieving apparatus of claim 6 wherein said housing is formed with a support ring projecting radially from said housing to house respective biasing springs and corresponding detent balls of said array of detent balls.

8. The baseball retrieving apparatus of claim 6 wherein the combined forces of the biasing springs exerted on the detent balls is greater than the weight of a maximum number of balls that can be retained in said tubular storage member.

9. The baseball retrieving apparatus of claim 8 wherein said housing is formed to receive an end of said tubular storage member within a portion of said housing allowing said passageway to be in communication with said tubular storage member.

10. The baseball retrieving apparatus of claim 9 wherein said housing is formed with an upper portion and a lower portion, said upper portion having an inside diameter that is substantially equal to an outside diameter of said tubular storage member, said lower portion having an inside diameter that is substantially equal to an inside diameter of said tubular storage member.

11. A ball retriever, comprising:

an elongated tubular storage chamber for storing a plurality of balls therein, the tubular storage chamber having an inside diameter that is sized to receive said balls in a linear arrangement; and a gateway mechanism mounted on a lower end of said tubular storage chamber to allow the passage of balls into said tubular storage chamber while preventing balls retained within said tubular storage chamber from passing back through said gateway mechanism, said gateway mechanism including:

a cylindrical housing defining a passageway therethrough for the passage of balls into said tubular storage chamber; and a circumferentially arranged array of detent balls mounted on said housing to project into said passageway and prevent the passage of balls through said passageway when said detent balls are projecting into said passageway, thus retaining said balls within said tubular storage chamber, each respective detent ball in the array of detent balls is spring-loaded to be biased toward said passageway, said housing being formed with a support ring projecting radially from said housing to house respective biasing springs and corresponding detent balls of said array of detent balls.

12. The ball retriever of claim 11 wherein the combined forces of the biasing springs exerted on the detent balls is greater than the weight of a maximum number of balls that can be retained in said tubular storage chamber.

13. The ball retriever apparatus of claim 11 wherein said housing is formed to receive an end of said tubular storage chamber within a portion of said housing allowing said passageway to be in communication with said tubular storage chamber.

14. The ball retriever of claim 13 wherein said housing is formed with an upper portion and a lower portion, said upper portion having an inside diameter that is substantially equal to an outside diameter of said tubular storage chamber, said lower portion having an inside diameter that is substantially equal to an inside diameter of said tubular storage chamber.

* * * * *